US005079777A

United States Patent [19]

Fowler et al.

[11] Patent Number: 5,079,777

[45] Date of Patent: Jan. 14, 1992

[54] TOP COVER ACCESSORY TO BE WORN ABOUT THE NECK DURING HAIR DRESSING

[75] Inventors: Nora L. Fowler; Mary M. Johnson, both of Oklahoma City, Okla.

[73] Assignees: Allan R. Fowler; Dunlap, Codding, Peterson & Lee, both of Oklahoma City, Okla.

[21] Appl. No.: 634,925

[22] Filed: Dec. 21, 1990

Related U.S. Application Data

[63] Continuation-in-part of Ser. No. 405,516, Sep. 11, 1989, abandoned.

[51] Int. Cl.[5] ..... A41D 13/00

[52] U.S. Cl. ..... 2/50; 2/46

[58] Field of Search ..... 2/50, 49 R, 49 A, 52

[56] References Cited

U.S. PATENT DOCUMENTS

| | | | |
|---|---|---|---|
| 2,282,183 | 5/1942 | Harris | 2/50 |
| 2,357,461 | 9/1944 | Ellinger | 2/50 |
| 2,794,985 | 6/1957 | Brennish | 2/50 |
| 2,851,690 | 9/1958 | Jennings | 2/50 |
| 3,031,676 | 5/1962 | Larson | 2/50 |
| 3,093,829 | 6/1963 | Maine | 2/48 |
| 4,139,912 | 2/1979 | Thuaud | 2/50 |
| 4,280,227 | 7/1981 | Brock | 2/50 |
| 4,663,779 | 5/1987 | Bible | 2/49 R |
| 4,709,420 | 12/1987 | Gettinger | 2/50 |
| 4,733,411 | 3/1988 | Foti | 2/49 R |
| 4,780,911 | 11/1988 | Mack | 2/50 |
| 4,797,952 | 1/1989 | Petrini | 2/50 |

FOREIGN PATENT DOCUMENTS

| | | | |
|---|---|---|---|
| 8706105 | 10/1987 | European Pat. Off. | 2/50 |

OTHER PUBLICATIONS

Baby's Bib (Exhibit A).

Betty Dain, "Neutralizing Head Cape" (Exhibit B).

Marianna, "Deluxe Neutralizing Bib with Removeable Pockets" (Exhibit C).

Betty Dain, "Will O' the Wisp" Comb-Out Make-Up Cape (Exhibit D).

Andre Fantasies, "Dri-Back TM" Taffeta Neckband Shampoo Cape with In-Sink Capelette.

*Primary Examiner*—William A. Cushlinski, Jr.

*Assistant Examiner*—William C. Dowling

*Attorney, Agent, or Firm*—Dunlap, Codding Peterson & Lee

[57] ABSTRACT

Disclosed is a protective cover combination for professional use in hair salons wherein a relatively small separate top cover accessory is secured about a person's neck at a position above the collar portion of a hair dressing cape and any towel captured under and extending over the rear of the collar portion. The top cover accessory comprises a pliable waterproof material having first and second ends with a cover portion therebetween, and covers portions of the cape and the exposed portions of the towel by extending over substantial portions of the shoulders and upper back of the person. The first end comprises a generally U-shaped neck-receiving portion having a border secured thereto which forms a narrow fluid-tight seal about rear and side portions of the neck when its extensions are tied about the front of the neck. When the person is reclined over a shampoo sink, a substantial portion of the accessory is disposed in the sink to shield the cape collar and towel as the fluids are applied to the person's head, and the accessory is separately released from the person to remain in the sink prior to moving the person to the upright position and making use of the dry towel.

15 Claims, 3 Drawing Sheets

TOP COVER ACCESSORY TO BE WORN ABOUT THE NECK DURING HAIR DRESSING

This application is a continuation-in-part of Ser. No. 07/405,516 filed Sept. 11, 1989, and now abandoned.

FIELD OF THE INVENTION

The present invention relates to a protective cover combination and methods for using the same to better protect a person from clipped hair and/or fluids applied to the head of the person during hair dressing operations.

SUMMARY OF THE INVENTION

The present invention comprises the combination of a relatively small top cover accessory with a relatively large hair dressing cape having a collar portion fastened about the person's neck, with or without a towel captured in part under the rear of the collar portion and extending over the rear of the collar portion and downward therefrom. The top cover accessory is separately and releasably secured about the person's neck at a position above the collar portion of the cape and any towel extending from thereunder. The top cover accessory comprises a compliant waterproof material having a first end and a second end, with a cover portion extending therebetween. The cover portion is disposed over the cape and any towel and covers a substantial portion of the person's shoulders and upper back with the second end of the material being capable of residing at about the middle of the person's back. The first end of the material comprises a generally U-shaped neck receiving portion capable of receiving rear and side portions of a person's neck, means for forming a narrow fluid-tight seal between the neck-receiving portion and said rear and side portions of the person's neck at a separate position above the collar portion of the cape and any towel portion extending from thereunder, and means closable about the front of the person's neck for releasably securing the tightening the neck-receiving portion and sealing means about the person's neck at said separate position irrespective of the upright or reclined disposition of the person.

The present invention further comprises a method for using the combination comprising installing the protective cover combination as above described in conjunction with an absorbent towel, removing the separate top cover accessory following performance of hair dressing, and addressing the person's hair with the pre-positioned towel. In the preferred method, the person is backwardly reclined with the person's head positioned over a shampoo sink, a substantial part of the cover portion of the accessory including the second end thereof is positioned in the shampoo sink so as to shield the cape collar and towel from fluids, and the top cover accessory is separately released and removed from the person while the person remains backwardly reclined over the shampoo sink and prior to moving the person back to the upright position, preferably leaving the wet top cover accessory remaining in the sink.

DETAILED DESCRIPTION OF THE PREFERRED EMBODIMENTS

Generally, at a beauty salon or barber shop, a towel is placed over the back of the neck of a patron and, the collar of; a cape is secured about the patron's neck and towel so that the towel is secured in part about the back of the neck and extends from under the rear of the collar and over the back of the cape. The towel is supposed to absorb any fluids that fall from the patron's head such as permanent solutions, rinses, tints, and bleaching solutions, or water during and after the shampooing process. Conventional capes have wide and leaky collars. In any event, the towel gets wet and does not stop all the fluids from going down the neck of the patron which sometimes ruins the patron's clothing and/or causes skin irritations or discomfort to the patron. The towel and/or the cape also do not effectively stop clipped hair during the hair cutting process from falling down the neck of the patron. The present invention creates an effective barrier against fluid applied to the hair of the patron and/or clipped hair which alleviates the foregoing problems, both when the patron sits upright or is reclined backwards over a sink.

Another problem with the cape and towel method previously described is that numerous towels are used in an attempt to keep the patron dry and comfortable which adds to the towel cleaning expense of the salon. Often the towels are damaged by the tints and bleaching solutions applied to the patron's hair which again increases the operating expense of the salon as the towels are replaced. The present invention, which is installed about the neck above and extends over the conventional cape, cape collar and towel as a separately releasable top cover accessory (FIG. 8), keeps both the cape collar and towel dry, thus protects the person and solves this problem by diminishing the need for towels in the salon setting.

Figure 1:
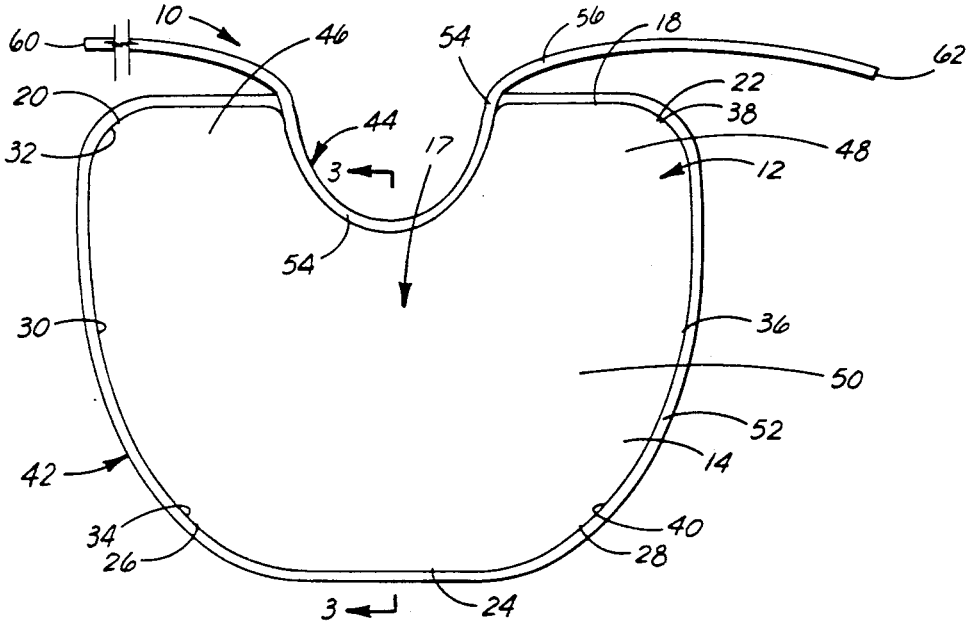
FIG. 1 is a top plan view of a separate top cover accessory constructed in accordance with the present invention.

Referring to FIG. 1, shown therein and designated generally by the reference numeral 10 is a cover top cover accessory which is constructed in accordance with the present invention for protecting at least a portion of a person from fluid applied to the head of the person and/or to prevent clipped hair from falling down the person's (hereafter "wearer's") back. The cover 10 comprises a material generally designated by the numeral 12 having an upper surface 14 and a lower surface 16. Any treated or untreated, natural or man-made material may be utilized for the material 12. The material 12 is waterproof and repels fluid in order to keep dry that which is covered by the cover 10. Man-made organic polymers include all polymers which can be formed into a sheet-like material which may be used in accordance with the present invention such as polyethylene and polypropylene.

The material 12 comprises at least one layer of material in a sheet-like form which is thin and very pliable. If more than one layer of material 12 is utilized, the layers may be separate or secured together. The material may also be pleated or gathered, but this is not preferred and in any event the border on the neck area must present a uniform narrow surface impressible under tension with the neck in order to provide a fluid-tight seal with the skin of the rear and side portions of the neck, and must not itself be gathered to afford creases within which fluid can leak down the neck. In a preferred embodiment shown in cross section in FIG. 3, two layers 12*a* and 12*b* were constructed from man-made organic polymer of the same thickness as shampoo capes presently on the market.

The material 12 comprises a first end 18 having a left terminal end 20 and a right terminal end 22, a second end 24 having a left terminal end 26 and a right terminal end 28, a third end 30 having a proximal end 32 and a terminal end 34, and a fourth end 36 having a proximal end 38 and a terminal end 40. The first end 18, second end 24, third end 30 and fourth end 36 form the periphery 42 of the material 12.

Figure 4:
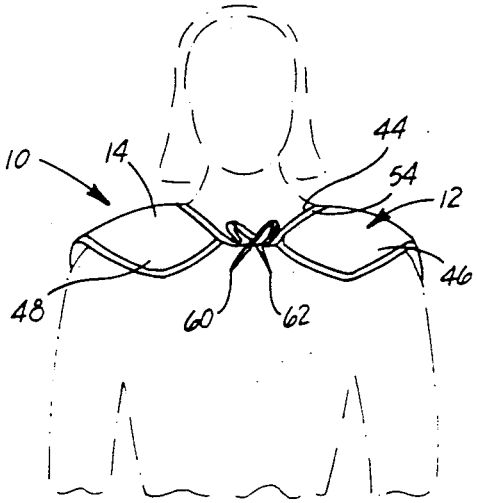
FIGS. 4 and 5 are respectively front and rear schematic views, generally illustrating the approximate lay and orientation of the top cover accessory of FIG. 1 about the shoulders and back of a person in the absence of an underlying cape and towel.

The first end 18 of the material 12 opposes the second end 24 of the material 12 with a cover portion 17 extending therebetween. Preferably the distance between the first end 18 and the second end 24 is in a range of less than about 9 inches to about 27 inches depending upon the size of the wearer. The first end 18 has a length of about the width of the wearer's shoulders, and preferably a little longer, so that the wearer's shoulders are substantially covered by the cover 10 as shown in FIG. 4, and comprises a generally straight line from the left terminal end 20 to the right terminal end 22 except for a neck-receiving portion. In a preferred embodiment, the first end 18 is about 20 inches long. Preferably the distance between the third end 30 and the fourth end 36 is less than about 9 inches to about 29 inches. In a preferred embodiment, the distance between the third end 30 and the fourth end 36 is about 21 inches at its widest point.

The neck-receiving portion, generally designated by the numeral 44, forms a generally "u-shaped" opening in about the middle of the first end 18 which is sized to receive rear and side portions of the neck of the wearer. In a preferred embodiment, the opening of the neck-receiving portion 44 on the first end 18 is about 8 inches long and extends, at the longest point, about 3½ inches from the first end 18 into the material 12.

The second end 24 of the material 12, which opposes the first end 18, is about as long as the first end 18 of the material 12, and may be smaller. Generally any length is acceptable for the second end 24 of the material 12 if the second end 24 of the material is disposable in a shampoo sink as described hereafter and covers a substantial portion of the wearer's upper back. Generally, the second end 24, when the cover is worn, will contact about the middle of the back of the wearer.

The third end 30 and the fourth end 36 connect the first end 18 and the second end 24 of the material 12. The proximal end 32 of the third end 30 of the material 12 connects to the left terminal end 20 of the first end 18; the terminal end 34 of the third end 30 connects to the left terminal end 26 of the second end 24; the proximal end 38 of the fourth end 36 connects to the right terminal end 22 of the first end 18; and the terminal end 40 of the fourth end 36 connects to the right terminal end 28 of the second end 24. The third end 30 and the fourth end 36 of the material 12 may form straight lines or be curved in any manner as long as a portion of the third and fourth ends are disposable in a shampoo sink.

Figure 6:
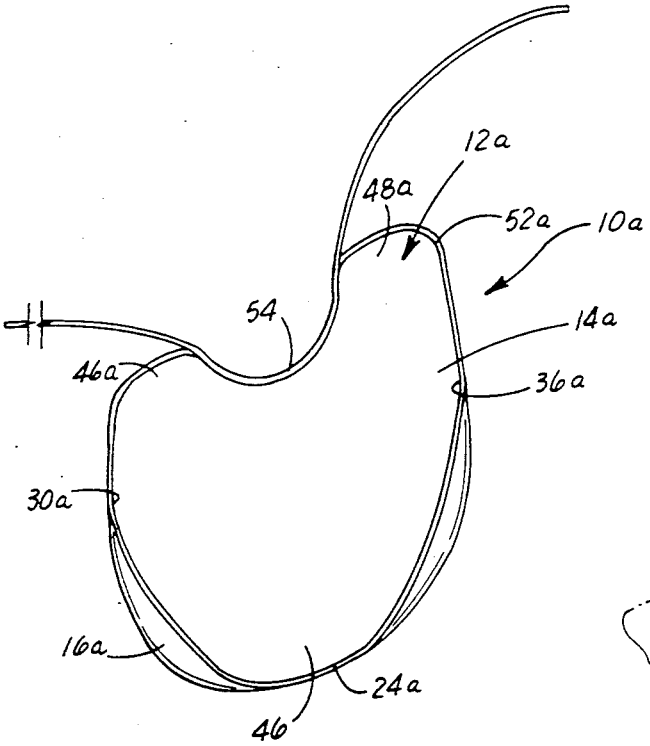
FIG. 6 is a perspective view of a variation of a top cover accessory constructed in accordance with the present invention.

In another embodiment shown in FIG. 6, a cover 10*a* is constructed in the same manner as previously described except a portion of the third end 30*a* and a portion of the fourth end 36*a* curl inward towards the upper surface 14*a* of the material 12*a*. This creates a path 46 on a portion of the upper surface 14*a* of the material 12*a* between the curled ends permitting fluid applied to the head of the wearer and/or clipped hair to more easily be removed from the cover 10*a* by flowing or sliding down the path 46. When the curled cover 10*a* is disposed in the shampoo sink, the curled portions of the cover 10*a* also serve to keep some of the fluids applied under pressure in the shampoo sink. The preset curl in the third end 30*a* of the material 12*a* and the fourth end 36*a* of the material 12*a* may be accomplished by thermosetting a thermosetable material such as a polypropylene which will retain a curl set therein or treating the material in any manner which will preset a curl in the material.

The cover portion 17 of the material comprises two shoulder portions 46 and 48 and a back portion 50. Between the third end 30 and the neck-receiving portion 44, adjacent a portion of the first end 18, is a left shoulder portion 46 of the material 12. Between the fourth end 36 and the neck-receiving portion 44, adjacent a portion of the first end 18, is a right shoulder portion 48 of the material 12. The left shoulder portion 46 and the right shoulder portion 48 are sized to cover a substantial portion of the wearer's shoulders when the cover 10 is worn as described hereafter. The shoulder portions 46 and 48 connect to a back portion 50, which is sized to cover a portion of the wearer's back and be disposable in a shampoo sink as described hereafter. Preferably the shoulder portions 46 and 48 and the back portion 50 form a continuous sheet of material 12.

In a preferred embodiment, the distance between the first end 18 and the second end 24, at the longest point, is about 16 inches, and the second end 24 contacts the wearer in about the middle of the back; the distance between the third end 30 and the fourth end 36, at the longest point, is about 20 inches. Preferably the third end 30 and fourth end 36 taper inward towards the second end 24 in order to fit in an unfolded position in the shampoo sink bowl as described hereafter.

The periphery 42 of the material 12, except for the neck-receiving portion 44, may be covered by a band 52 which covers the raw edge of the material (not shown) and/or secures together multiple layers of material. Preferably the band 52 is sewn on the material, but may be secured by any other means. In one embodiment the band 52 comprises a strip of polypropylene sized to cover about ¼ of an inch of each side of the periphery 42 and is secured to the material 12 by sewing, the same being true of the border 54 in the neck receiving portion, thus adding substance and weight to the edge portions of the material and when sewn being essentially flat without the exaggeration shown, for example in FIG. 3.

The cover 10 further comprises a narrow elongate border 54, having an upper surface 56 and a lower surface 58, which is secured to the neck-receiving portion 44. The upper surface 56 and the lower surface 58 only comprise the portion of the border 54 visible after the border 54 has been secured to the neck receiving portion 44. The border 54 further comprises a first end 60, a second end 62, a third end 64 and a fourth end 66. The length of the border 54 from the first end 60 to the second end 62 is at least as long as the neck-receiving portion 44, and is preferably of sufficient length to tie the first end 60 portion of the border 54 and the second end 62 portion of the border 54 together about the front of the neck of the wearer. Other means of securing the cover 10 to the person may be utilized as long as the border forms a fluid-tight seal about a portion of the neck of the wearer, e.g., velcro or snaps.

The border 54 may be constructed from any suitable material which is pliable enough to conform to the shape of the wearer's neck under modest tension to provide a narrow fluid-tight seal with the rear and side portion of the neck. Preferably the border 54 is constructed from a pliable, waterproof material such as man-made organic polymer. The border 54 may comprise one strip of unfolded material secured to the neck-receiving portion 44 or a plurality of strips of material or one strip folded at least once.

Figure 2:
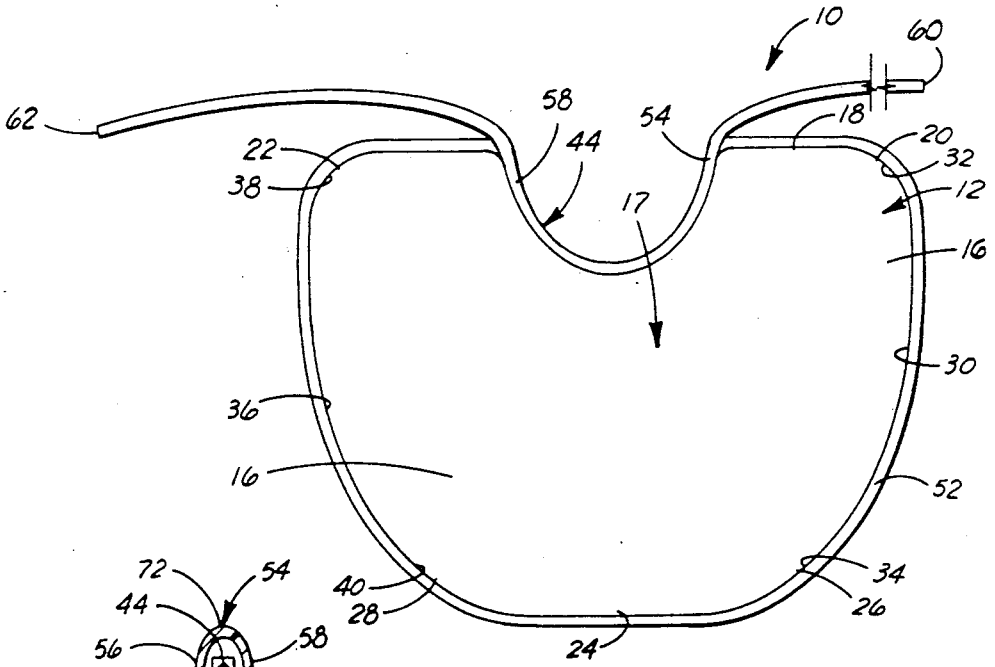
FIG. 2 is a bottom plan view of a separate top cover accessory constructed in accordance with the present invention.

In one embodiment, the border 54 is constructed from a strip of nylon. As shown in cross-section in FIG. 3, the third end 64 and the fourth end 66 of the border 54 are turned inward a distance away from the upper surface 56 and lower surface 58 of the border 54 to form a third end fold 68 and a fourth end fold 70. A top fold 72 is formed in about the middle of the border 54 between the third end 64 and the fourth end 66 of the border 54 as the neck receiving portion 44 is received in the space created by folding the border 54 as described and shown in FIG. 3. The border 54 is then secured to the material 12, preferably by sewing the border 54 to the neck-receiving portion 44, although adhesives, heat sealing, or any other appropriate method may be utilized to secure the border 54 to the material 12. The band 52, previously described, may be constructed from the same material as the border 54 and secured in the same manner. The border 54 may also be constructed from a single strip of unfolded material secured to the material 12. The border 54 may be secured to the material 12 so that the border is in the same horizontal plane as the material 12, i.e. flat (as shown in FIGS. 1 and 2), or the border 54 may be secured so that at least a portion of the border 54 is about at a right angle to the material 12 (not shown) or any other angle which positions the lower surface 58 of the border 54 to more easily conform to the wearer's neck.

Figure 3:
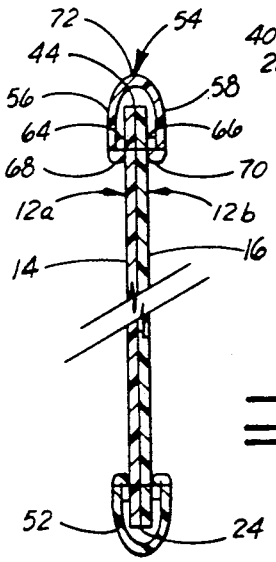
FIG. 3 is a sectional view partially broken away and enlarged and exaggerated for clarity, taken along line 3—3 of FIG. 1.

It is believed that the narrow width of the surfaces 56 and 58 of the border 54 as well as the type of material utilized for the border 54, aid in forming an effective barrier to the clipped hair and fluids by impressing the skin and conforming to the wearer's neck. In FIG. 3, the width of the surfaces 56 and 58 is the distance between the top fold 72 and the third end fold 68, and the distance between the top fold 72 and the fourth end fold 70, and is preferably in a range of less than about $\frac{1}{8}$ of an inch to about $\frac{3}{8}$ of an inch for each surface. In general, the "width of the surfaces" means that portion of each side of the border 54, which is visible after the border 54 has been secured to the material 12.

Figure 5:
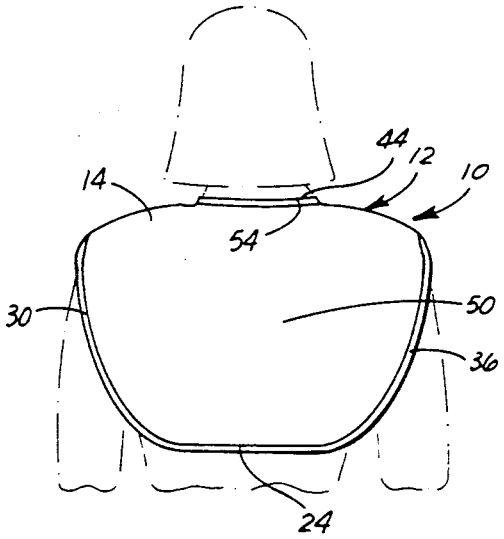
Figure 7:
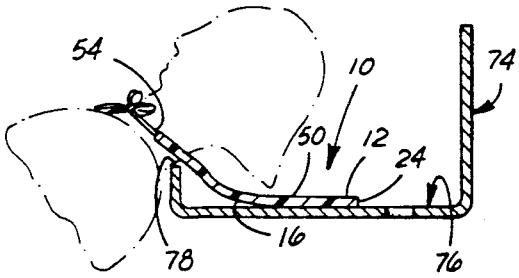
FIG. 7 is a partial cross-sectional side view showing a person backwardly reclined over a shampoo sink with a substantial portion of the top cover accessory disposed in the sink.

In general, the cover 10 is placed on the back and shoulders of the wearer as shown in FIGS. 4 and 5, the lower surface 58 of the border 54 is placed against the back of the wearer's neck, and the first end 60 portion of the border 54 and the second end 62 portion of the border 54 are tied firmly together about the front of the neck whereby the border 54 conforms under tension to the wearer's neck. The wearer is positioned at a shampoo sink 74 of the type normally used in salons, and as shown in FIG. 7, wherein a portion of the lower surface 16 of the cover 10 contacts a portion of the bowl 76, the interior of the shampoo sink 74, in an unfolded position. "Unfolded position" means that the cover 10 is disposed in the bowl 76 such that the cover 10 is not folded or bent to a degree which would substantially impede the flow of fluids from the person's head or substantially deflect the fluids applied under pressure to the cover 10 causing the fluids to spray upward from the bowl 74. The neck support area 78 of the shampoo sink 74 contacts the neck of the wearer between the cover 10, secured about the neck, and the back of the wearer, so that the second end 24 of the material 12 and the back portion 50 of the material 12 is disposed in the bowl 76.

After rinsing or shampooing, the cover 10 is released from the person, in this embodiment untied, and allowed to remain in the sink as the wearer sits upright. A towel is placed over the wearer's hair to absorb the fluid thereon.

Figure 8:
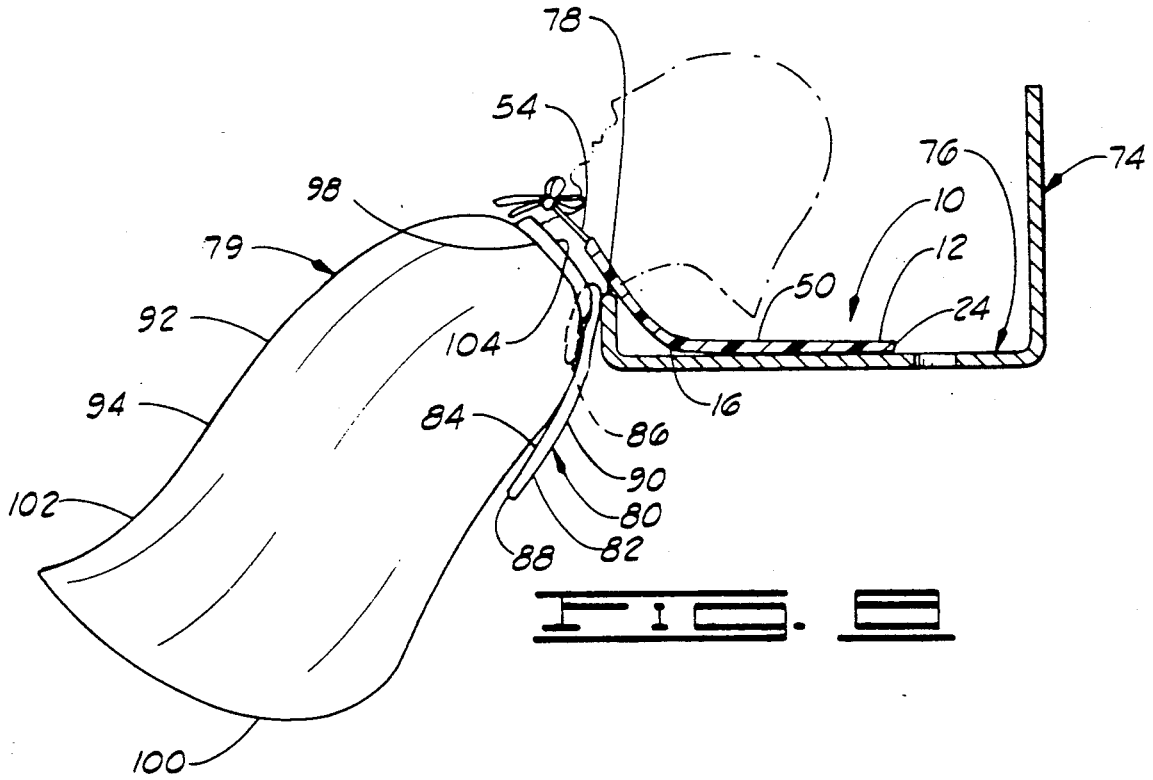
FIG. 8 is a partial cross-sectional view showing the preferred disposition of the top cover accessory about the neck relative to an underlying cape, cape collar and towel, and a person performing a method of the present invention.

In the preferred usage of the invention shown in FIG. 8, a cape 79 and a towel 80 are worn under the cover 10. The towel 80, which includes any absorbent material, comprises an upper surface 82, a lower surface 84, a first end 86, and a second end 88 with an absorbent area 90 between the first end 86 and the second end 88. The upper surface 82 of the towel is disposed over the back of the wearer's neck and head. The cape 79 comprises a sheet of material 92 comprising an upper surface 94, a lower surface (not shown), a first end 98, and a second end 100 with a cape-cover portion 102 between the first end 98 and the second end 100. The cape-cover portion 102 is sufficiently sized to substantially shelter or cover the person's torso and shoulders. The first end 98 of the cape 79 is capable of fitting about the neck of the wearer. Conventionally the first end 98 is secured to a collar 104 which fits about the neck and substantially encircles same in order to be secured about the wearer's neck. The collar is secured about the neck by any appropriate means such as velcro, snaps, hooks, or ties. Generally the cape 79 will cover the shoulders and the wearer's torso, i.e, the back and front of the wearer from the neck down to at least the waist and usually over the lap of the wearer when the wearer is in a sitting position. The sheet of material 92 and the collar 104 are preferably constructed from the same material such as polyester and/or cotton. An example of a cape utilized in accordance with the present invention is a shampoo cape manufactured by Betty Dain of Mialeah, Fla.

The absorbent area of the towel is sufficiently sized to be positioned between the collar 104 of the cape 79 and still extend a sufficient distance to substantially cover the hair on the head so that fluids applied to the hair may be absorbed by a portion of the towel 80. A standard-sized towel, approximately 14 inches by 10 inches normally utilized in salons is sufficient for purposes of the present invention. The upper surface 82 of the towel 80 is placed over the back of the neck and the head of the wearer. The cape 79 is secured about the wearer's neck by fastening the collar 104 about the neck and capturing under the rear of the collar a portion of the towel 80. The portion of the towel 80 that covers the head is removed from the head and placed over the back of the cape 79 so that a portion of the lower surface of the towel 80 contacts a portion of the upper surface 94 of the cape 79. The cover 10 is next releasably secured to the wearer as previously described at a separate location on the neck above the cape 79, collar 104, and towel 80 as shown in FIG. 8.

After rinsing or shampooing, the cover 10 is released from the person and allowed to remain in the sink as the wearer sit upright. The portion of the towel 80 extending form the collar 104 is placed on the wearer's hair to absorb the fluids therefrom.

The present invention may also be utilized when hair is cut or when fluids are applied to the person's head while the person sits upright. The cover 10 is secured about the wearer's neck as previously described, and the hair is cut or fluids applied. After the hair is cut, the wearer's neck exposed above the cover 10 is cleared of cut hair and the cover 10 is removed.

Changes may be made in the embodiments of the invention described herein or in parts or elements of the embodiments described herein or in the steps or in the sequence of steps of the methods described herein without departing from the spirit and scope of the invention as defined in the following claims.

What is claimed is:

1. A protective cover combination secured about a person's neck during hair dressing operations so as to shelter against fluids applied to the person's hair and/or against hair clippings, whether the person be situated in an upright sitting position or moved between a upright sitting position and a backwardly reclined position where the person's head is situated over a shampoo sink, said protective cover combination comprising:

A) a relatively large hair dressing cape having a collar portion fastened about the person's neck, with the cape extending over substantial portions of the torso of the person;

B) a relatively small top cover accessory separately and releasably secured about the person's neck at a position above the collar portion of the cape, said top cover accessory comprising:

(a) a compliant waterproof material comprising a first end and a second end having a cover portion therebetween wherein the cover portion is relatively small compared to the cape, and is disposed over the cape to cover a substantial portion of the person's shoulders and upper back, with the second end of the cover portion residing at about the middle of the back with the person in the upright position, and wherein the first end comprises a generally U-shaped neck-receiving portion capable of receiving rear and side portions of the person's neck;

(b) sealing means for forming a narrow fluid-tight seal between the neck-receiving portion and said rear and side portions of the person's neck at a separate position above the collar portion of the cape; and (c) means closeable about the front of the person's neck for releasably securing and tightening the neck-receiving portion and sealing means about the person's neck at said separate position irrespective of the upright or reclined disposition of the person.

2. The apparatus of claim 1 wherein:

(a) the sealing means for forming a fluid-tight seal between the neck-receiving portion and said portions of the person's neck comprises: an elongated, narrow, waterproof, compliant border secured to the U-shaped neck-receiving portion and capable of substantially conforming under tension to the person's neck to form a fluid-tight seal about said portions of the person's neck; and, (b) wherein the releasable securing means is coupled to said border and extends therefrom at each end of the U-shaped neck receiving portion for releasably joining about the front portion of the person's neck to exert about the neck sufficient tension on the border to cause it to a seal against said back and said portions of the person's neck.

3. The apparatus of claim 2 wherein the material further comprises an upper surface and a lower surface, and the border secured to the neck-receiving area further comprising an upper border surface adjacent the upper surface of the material and a lower border surface adjacent the lower surface of the material, each border surface having a width in a range of less than about ⅛th of an inch to about ⅜th of an inch.

4. The apparatus of claim 1 wherein the sealing means and means for releasably securing the neck receiving portion and sealing means to the person's neck comprises an elongated narrow, waterproof compliant border, said border comprising:

a first end, a second end, a third end, a fourth end, wherein the third end and the fourth end of the broader are secured to the U-shaped neck-receiving portion of the material, and the first end of the border and the second end of the border sufficiently extend past the neck-receiving portion so that the first end portion and the second end portion are capable of releasably tying together about the front of the person's neck such that the border forms a fluid tight seal about said portions of the neck.

5. The apparatus of claim 1 wherein the material comprises at least two layers of material.

6. The apparatus of claim 2 wherein the material comprises man-made organic polymer.

7. The top cover accessory of claim 2 wherein the border comprises man-made organic polymer.

8. The apparatus of claim 1 wherein the material further comprises an upper surface, a lower surface, a third end connecting a portion of the first end of the material and the second end of the material, and the fourth end connecting a portion of the first end of the material and the second end of the material, wherein the lower surface of the material resides over a portion of the person's neck and shoulders when the top cover accessory is worn by the person, and a portion of the third end and a portion of the fourth end curl upward towards the upper surface forming a path therebetween on a portion of the cover portion such that hair and fluids from the person's head which fall onto the upper surface of the material are guided into the path and away from the top cover accessory.

9. The apparatus of claim 1 wherein the distance between the first end of the material and the second end of the material is in a range of less than about 9 inches to about 27 inches; wherein, the material further comprises a third end connecting a portion of the first end of the material and the second end of the material, and a fourth end connecting a portion of the first end of the material and the second end of the material; and, wherein an elongated compliant border is secured to the material along its first, second, third and fourth ends, said border extending along the first end serving as the sealing means in the U-shaped neck-receiving portion of said first end.

10. A protective cover combination secured about a person's neck during hair dressing operations so as to shelter against fluids applied to the person's hair and/or against hair clippings, whether the person be situated in an upright sitting position or moved between an upright sitting position and a backwardly reclined position where the person's head is situated over a shampoo sink, said protective cover combination comprising:

A) a relatively large hair dressing cape having a collar portion fastened about the person's neck, with the cape extending over substantial portions of the torso of the person;

B) an absorbent towel captured in part under the rear of the collar portion of the cape and extending over the rear of the collar portion and exteriorly downward therefrom;

C) a relatively small top cover accessory separately and releasably secured about the person's neck at a position above the collar portion of the cape and the towel extending from thereunder, said top cover accessory comprising:

(a) a compliant waterproof material comprising a first end and a second end having a cover portion therebetween wherein the cover portion is relatively small compared to the cape and is disposed over the cape and towel to cover a substantial portion of the person's shoulders and upper back as well as cover that portion of the towel extending from under the collar portion of the cape, with the second end residing at about the middle of the back with the person in the upright position, and wherein the first end comprises a generally U-shaped neck-receiving portion capable of receiving rear and side portions of the person's neck;

(b) sealing means for forming a narrow fluid-tight seal between the neck-receiving portion and said rear and side portions of the person's neck at a separate position above the collar portion of the cape and the towel portion extending from thereunder; and, (c) means closeable about the front of the person's neck for releasably securing and tightening the neck-receiving portion and sealing means about the person's neck at said separate position irrespective of the upright or reclined disposition of the person.

11. A method to protect a portion of a person from fluids applied to the person's head and/or hair clipped from the person's head, comprising the steps of:

(a) providing a cape to be worn about the person's neck said cape comprising:

a sheet of material comprising an upper surface and a lower surface, a first end and a second end having a cape-cover portion therebetween wherein the cape-cover portion is sized sufficiently to substantially shelter the person's torso and shoulders, a collar secured to the first end of the sheet capable of substantially encircling the person's neck; and, means for securing the collar of the cape about the person's neck;

(b) providing an absorbent towel;

(c) securing the collar of the cape about the person's neck while capturing under the collar a portion of the towel about the rear of the person's neck such that a substantial portion of the towel extends over the rear of the collar and downwardly over a portion of the cape on the person's back (d) providing a separate top cover accessory to be worn about the person's neck above the cape collar and towel, said separate top cover accessory comprising:

a compliant waterproof material comprising an upper surface and a lower surface, and a first end and a second end having a cover portion therebetween, wherein the cover portion is relatively small compared to the cape, but is sized sufficiently to substantially shelter the person's shoulders and upper back as well as the towel from fluids and hair, and the second end of the cover portion contacts the person in about the middle of the back when the cover is worn with the person in an upright position, and wherein the first end comprises a generally U-shaped neck-receiving portion capable of receiving rear and side portions of the person's neck;

sealing means for forming a narrow fluid-tight seal between the neck-receiving portion and said rear and side portions of the person's neck at a separate position above the cape collar and towel; and means for releasably securing and tightening the U-shaped neck-receiving portion and sealing means about the front of the person's neck at said separate position irrespective of the upright or reclined disposition of the person;

(e) securing the separate top cover accessory about the person's neck at said position above the cape collar and towel, so that a fluid tight seal is formed between the U-shaped neck-receiving portion and said rear and side portions of the neck; and, (f) removing the top cover accessory following performance of hair dressing, and addressing the person's hair with the towel.

12. The method of claim 11 further comprising:

(a) reclining the person over a shampoo sink having a bowl for receiving fluids and a neck-support area adjacent a portion of the bowl, wherein the back of the neck of the person is received on the neck support area thereby supporting the person's head over the bowl;

(b) positioning a substantial portion of the cover portion including the second end thereof in the bowl of the shampoo sink in a substantially unfolded position such that fluid applied to the person's head may flow onto the cover portion and into the bowl, without wetting the cape collar or towel; and, (c) releasing the secured top cover accessory from the person such that the wet top cover accessory remains in the bowl as the person is moved to the upright position; and (d) disposing a portion of the absorbent towel on the person's hair to absorb the fluids therefrom.

13. The method of claim 12 wherein the separate top cover accessory further comprises a border, said border comprising a waterproof compliant material having a first end, a second end, a third end, and a fourth end, wherein the third end and the fourth end of the border are secured to the U-shaped neck-receiving portion of the material and the first end of the border and the second end of the border sufficiently extend past the neck-receiving portion so that the first end portion and the second end portion are capable of tying about the front of the person's neck so as to tension the border to form a fluid tight seal about said rear and side portions of the neck, and, wherein the cover is secured to the person by tying the border about the neck.

14. The method of claim 13 wherein the top cover accessory is released from the person by untying the first end portion and the second end portion of the border.

15. The method of claim 13 wherein the border comprises an upper surface and a lower surface, each surface having a width in a range of less than about $\frac{1}{8}$ of an inch to about $\frac{3}{8}$ of an inch.

* * * * *